US005597097A

United States Patent [19]

Morris

[11] Patent Number: 5,597,097

[45] Date of Patent: Jan. 28, 1997

[54] FLUID DISPENSING CONTAINER

[76] Inventor: Glenn Morris, 8080 Banks Mill Rd., Douglasville, Ga. 30135

[21] Appl. No.: 371,415

[22] Filed: Jan. 11, 1995

[51] Int. Cl.[6] ..... B67D 5/06

[52] U.S. Cl. ..... 222/529; 222/530

[58] Field of Search ..... 222/529, 530, 222/481.5, 482, 572

[56] References Cited

U.S. PATENT DOCUMENTS

| | | | |
|---|---|---|---|
| 1,287,046 | 12/1918 | Knapp | 222/482 |
| 1,362,186 | 12/1920 | Price | 222/529 |
| 1,591,623 | 7/1926 | Hassensall | 222/185 |
| 1,808,029 | 6/1931 | Frame | 222/530 |
| 1,832,798 | 11/1931 | Taylor | 222/182 |
| 1,913,895 | 6/1933 | Paull | 222/530 |
| 2,372,281 | 3/1945 | Jordan | 222/482 |
| 2,630,247 | 3/1953 | Rafferty | 222/530 |
| 2,831,610 | 4/1958 | Dennie | 222/105 |
| 3,170,601 | 2/1965 | Daley | 222/153 |
| 3,319,834 | 5/1967 | Steele | 222/482 |
| 3,395,740 | 8/1968 | Sutcliffe | 141/392 |
| 3,729,122 | 4/1973 | Flider | 222/482 |
| 4,416,396 | 11/1983 | Ward | 222/530 |
| 4,428,507 | 1/1984 | Sneider | 222/530 |
| 4,650,100 | 3/1987 | Echazabal, Jr. | 222/475 |
| 4,781,314 | 11/1988 | Schoonover et al. | 222/465 |
| 4,972,972 | 11/1990 | Goguen | 222/530 |
| 5,000,360 | 3/1991 | Lown et al. | 222/521 |
| 5,244,021 | 9/1993 | Hau | 141/285 |
| 5,295,610 | 3/1994 | Levison | 222/482 |

FOREIGN PATENT DOCUMENTS

| | | | |
|---|---|---|---|
| 597218 | 5/1918 | Canada | 222/527 |

*Primary Examiner*—Philippe Derakshani
*Attorney, Agent, or Firm*—Isaf, Vaughan & Kerr; Charles H. Fails

[57] ABSTRACT

A fluid dispensing container (5) having a generally rectangular and planar top wall (10), a pair of generally rectangular and coplanar opposed sidewalls (18), a front wall (22), and an opposed back wall (23), fastened to one another along their common edges. A generally rectangular and planar interior partition (30) is fastened to and sealed on the sidewalls (18), front wall (22), and rear wall (23) intermediate the first and second ends of each wall, respectively, to form sealed fluid container (5). Interior partition (30) is angled downward from rear wall (26) toward front wall (22). A fluid outlet opening (32) is defined in the second end of front wall (22) adjacent interior partition (30). A flexible hose (36) is fastened in sealed fluid communication with fluid outlet opening (32), hose (36) having a nozzle (40) fastened to its free end in sealed fluid communication. Nozzle (40) is adapted to be selectively opened and closed. A fluid inlet opening (46) is defined in the corner of fluid container (5) where top wall (10) and front wall (22) meet, and a fluid fill conduit (48) extends upward from fluid inlet opening (46) with respect to both top wall (10) and front wall (22). A cap assembly (50) is removably received on the other end of fluid fill conduit (48). Cap assembly (50) includes a vent (52) adapted to be selectively opened and closed for venting the interior of fluid container (5). Fluid container (5) also has a recessed channel (60) formed along the length of its front wall (22) for receiving hose (36). A pair of clamps (66) are mounted within recessed channel (60), for holding hose (36) within the channel.

22 Claims, 2 Drawing Sheets

FLUID DISPENSING CONTAINER

FIELD OF THE INVENTION

This invention relates in general to fluid containers, and, more particularly, relates to fluid containers for transporting, pouring and dispensing fluids, to include motor fuels, lubricants, hydraulic fluids, and the like.

BACKGROUND OF THE INVENTION

Fluid containers of a number of shapes and sizes, and made for a number of purposes, are known in the art. Fluid containers have been created for the transport and pouring of fluids to include motor fuels, lubricants, and hydraulic fluids, as well as for the transport and pouring of potable fluids, to include coffee and tea. Rigid and durable fluid containers have been constructed in the art which are intended to be repeatedly used for fluid storage and transport, as well as disposable containers for the storage and pouring of fluids to be used on a one time basis in the event of an emergency.

An example of a fluid container known in the art is disclosed in the patent to Schoonover et al., U.S. Pat. No. 4,781,314. In Schoonover et al. a fuel container is taught having a housing arranged in a box like fashion, with two square side walls, each side wall having four edges and four corners, two top walls adjoining one another at a corner extending between adjacent corresponding edges of the side walls, and two bottom walls adjoining one another at the opposite corner and extending between the two remaining adjacent corresponding sides of the side walls. At each end of the top walls, respectively, first and second threaded neck portions are provided, the neck portions being spaced as far away from the other as possible, for receiving thereon either a threaded cap, or, in the alternative, a threaded spout having a valve provided as a part thereof, the spout being formed of flexible material for directing the fluid to be poured from the fluid container. However, in the fluid container of Schoonover et al., as well as other similar fluid containers, the cap received on one of the threaded neck portions must first be removed and the spigot threaded thereon, and the fluid container must then be lifted into position and held in position while fluid is poured or emptied from the container. Moreover, in order to fully drain the fluid container of Schoonover et al., as well as similar fluid containers, the fluid container must be angled or tilted toward the spigot fastened to one of the threaded neck portions.

Another fluid container known in the art is the fuel transfer container of Hau, U.S. Pat. No. 5,244,021. In Hau, a container is disclosed having an opening, or openings, through which a delivery conduit is arranged as well as a pressurizing squeeze bulb in pneumatic communication with the interior of the container for effecting the pressurization of fuel and fluid contained in the container, so that the fluid may be pumped into the lower end of the delivery conduit in the container, passed into and through the delivery conduit, and into and through a flexible delivery tube. However, in order to use the fuel transfer container of Hau, air must first be pressurized in the container by pumping air into the container with the squeeze bulb, and if any problems arise in sealing the container, to include the fuel delivery conduit and the squeeze bulb conduit, the transfer of fuel will become more difficult. Should the squeeze bulb or air pressurization device fail or become blocked or obstructed, however, then the fuel transfer container will be need to be lifted and held in position as fuel is poured out of the container.

A disposable dispensing container is disclosed in U.S. Pat. No. 4,650,100 to Echazabal, Jr., in which a disposable packaging and dispensing container is formed as an integral one piece molded container. In Echazabal, Jr., a channel is formed along two opposed sides of the container as well as through the handle of the container, in which a flexible hose is held until such time as the dispensing container is to be used, whereupon the hose is removed and fluid passed from the container through the hose. Thereafter, the dispensing container of Echazabal, Jr. is disposed of, the container not being adapted for reuse, nor being provided with a means to fill the container with fluids for further use.

None of the prior art known to the inventor discloses or illustrates a reusable fluid container designed and constructed to be resistant to spills and used in a variety of applications, and with a variety of fluids, where the container does not need to be lifted and held, and angled or tilted as fluid is passed therefrom into another container or fluid vessel, or where the fluid container is designed to fully drain itself, and where the fluid container is sized and shaped to facilitate stacking the container side by side, and one on top of another, with similarly constructed containers.

Thus, the need exists for an improved yet simple and spill resistant fluid container adapted to carry any number and type of fluids, where the fluid container can be set down and rested without having to lift the container up and hold the container above the point to which the fluid is passed, while the construction of the fluid container assists in the full drainage of the container, and where the container may be stored not only by standing it up on its bottom wall, but by also placing the container on its back wall so that the container can be stacked side by side, and one on top of another with similarly shaped fluid containers.

SUMMARY OF THE INVENTION

The present invention provides an improved fluid container which overcomes some of the design deficiencies of other fluid and fuel containers known in the art by providing a fluid container with an inclined fluid fill conduit, a cap removably received on the fluid fill conduit having an integral vent formed as a part thereof, an inclined interior partition adapted to assist in full drainage of the container leading to a fluid outlet opening defined in the bottom of the front wall of the container to which a flexible hose is permanently affixed in sealed fluid communication, a nozzle being fastened in sealed fluid communication at the other end of the hose, where the nozzle is adapted to be selectively opened and closed for passing fluid from the container.

The fluid container of type described herein has a top wall with a first end and a second end, a front wall, an opposed back wall, and a pair of opposed sidewalls, each of the walls having a first end and a second end. Each of the opposed sidewalls is fastened at its first end to the side edges of the top wall and extends between the first and second ends of the top wall. The front and back walls are also fastened at their first ends to the first end and the second end of the top wall, respectively, and fastened along their common side edges to each adjacent sidewall, thus forming a housing for the fluid container. An interior partition is positioned within the container, the partition being spaced intermediate the first and second ends of the front wall, back wall, and sidewalls, the partition also being fastened along its side edges to the front wall, back wall, and sidewalls. The partition is angled downward from the back wall toward the front wall with respect to the front wall, back wall, and sidewalls.

A fluid outlet opening is defined in the front wall of the fluid container adjacent the interior partition, whereupon the first end of an elongated hose is fastened in sealed fluid communication with the fluid outlet opening, with a nozzle fastened in sealed fluid communication with the second end of the hose, the nozzle being adapted to be selectively opened and closed for passing fluid through the hose.

A fluid inlet opening is defined at the corner of the container where the front and top walls are joined to one another at their first ends, respectively. A fluid fill conduit extends from the fluid inlet opening and is angled upward with respect to both the top wall and the front wall of the container in order to prevent spillage of fluid therethrough when the container is stored on its bottom wall or its back wall. A cap is removably received on the other end of the fluid fill conduit for sealing the fluid inlet opening closed on the container, and a vent or relief valve is provided in the cap to relieve interior pressure build up and to assist in venting the interior of the container as fluid is passed out of the fluid outlet opening and through the hose and nozzle. A lip can be formed around the periphery of the nozzle transverse to its length to assist in holding the nozzle inside the openings of fuel tanks or other fluid containers or vessels into which the nozzle may be placed for transferring fluid from the container. In addition, a recessed channel can be formed along the length of the front wall into which the hose is placed, and held in position for storage, to protect and store the hose.

Thus, it is an object of this invention to provide an improved fluid dispensing container which can be used to transfer or pour fluid that does not have to be lifted and held in position above the point to which fluid is being transferred.

An additional object of the invention is to provide an improved fluid dispensing container which will avoid spills of fuel or other fluids onto machinery, engines, and other equipment into which fluid is being transferred from the fluid container.

Another object of the invention is to provide an improved fluid dispensing container which can be stored in two positions, on its bottom, or along its back wall, and stacked to efficiently store the fluid container.

Still another object of the invention is to provide an improved fluid dispensing container which does not have to be tilted or angled in order to pour fluid from the container, and to ensure that fluid is fully drained from the container.

An additional object of the invention is to provide an improved fluid dispensing container which is easy to handle and use, and which will not lead to undue strain in having to carry and support the fluid container as fluid is being transferred therefrom.

It is also an object of the invention to provide an improved fluid dispensing container which is simple in design and operation, is inexpensive to construct, and is durable and rugged in structure.

Thus, these and other objects, features, and advantages of the invention will become apparent upon reading the specification when taken in conjunction with the accompanying drawings, wherein like characters of reference designate corresponding parts throughout the several views.

DETAILED DESCRIPTION

Figure 1:
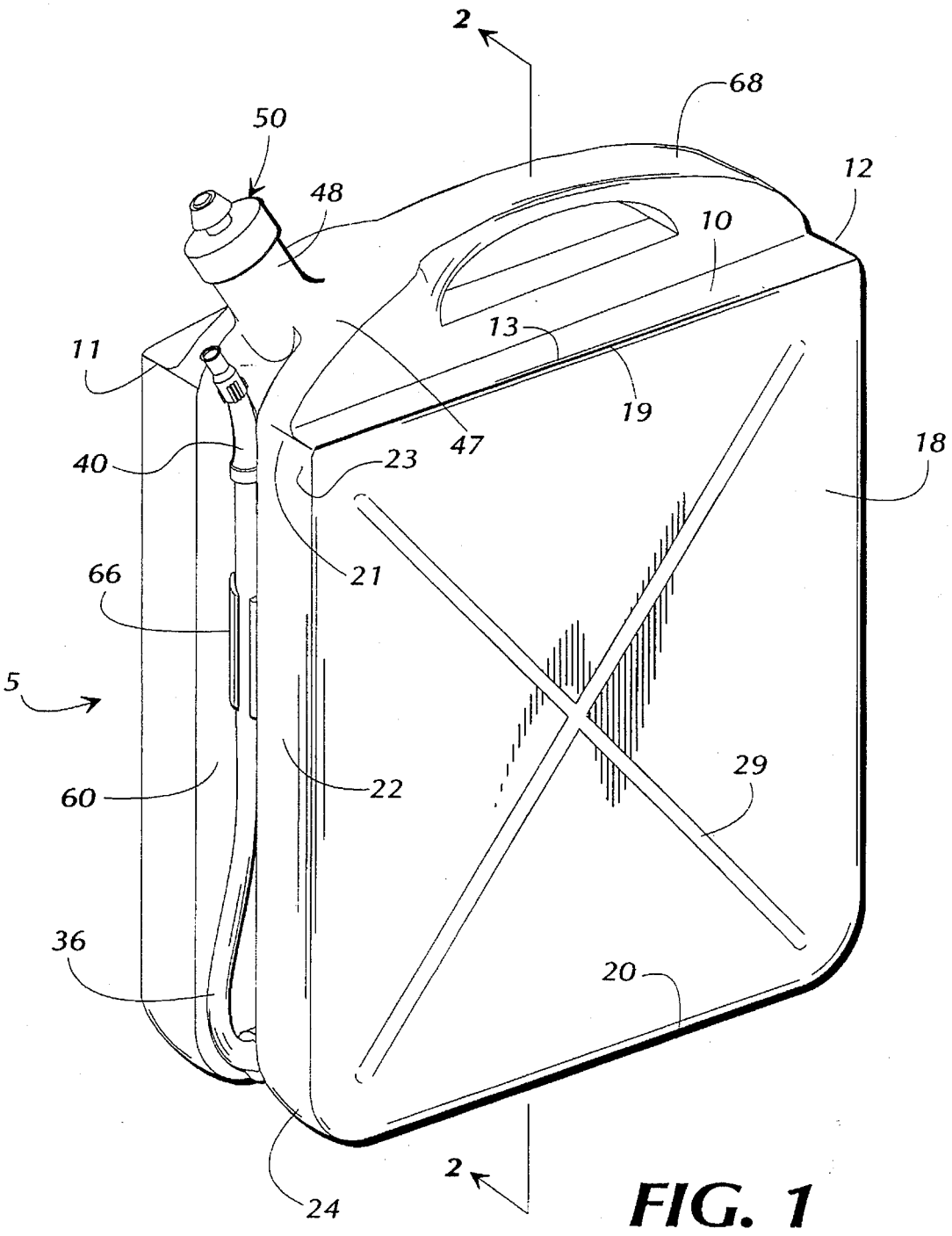
FIG. 1 is front perspective view of a preferred embodiment of the fluid dispensing container.
Figure 2:
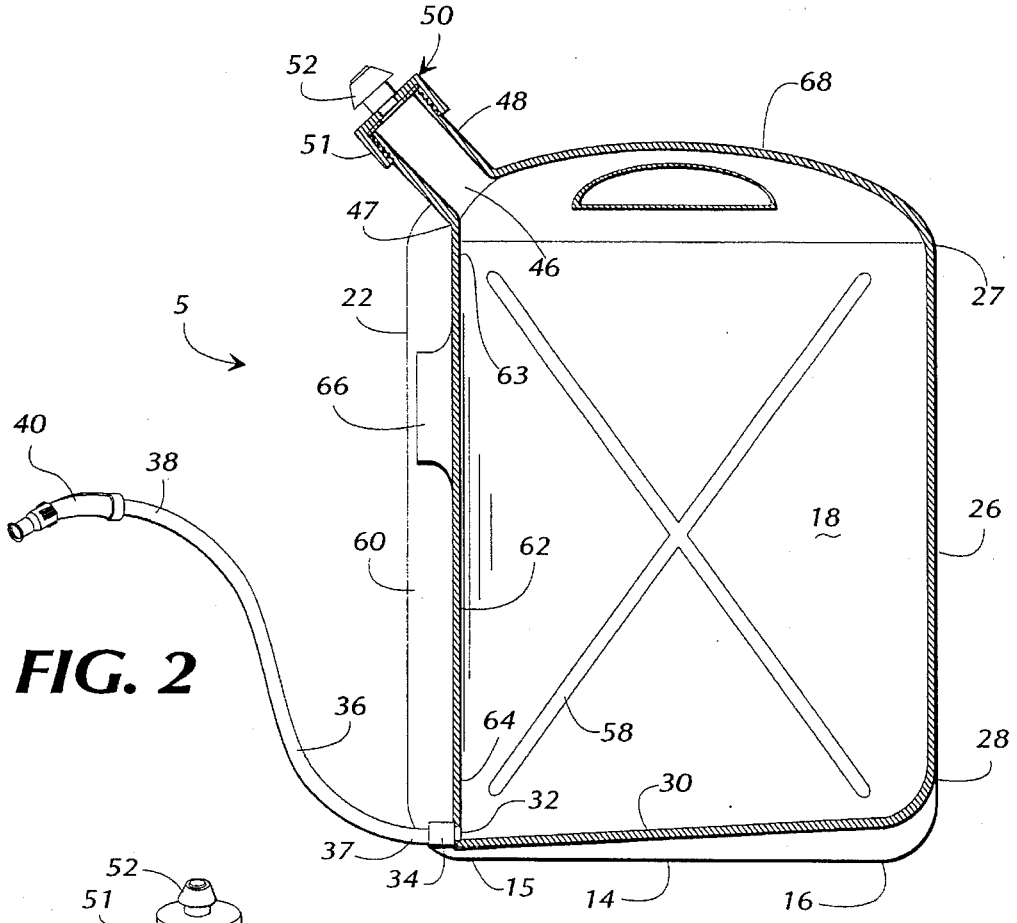
FIG. 2 is a side elevational view of the fluid dispensing container in cross-section along line 2—2 of FIG. 1.

Referring now in detail to the drawings, in which like reference numerals indicate like parts throughout the several views, numeral 5 of FIGS. 1 and 2 illustrates a preferred embodiment of a fluid dispensing container. Fluid container 5 is shown as having a generally rectangular or cube like configuration. However, it is understood by those knowledgeable in the art that fluid container 5 can also be constructed as a cylindrical fluid container having a continuous curved sidewall, as well as being constructed in any other number of possible configurations, so long as fluid container 5 is constructed as a sealed container for carrying, transporting, and storing fluids.

Referring now to FIG. 1, fluid container 5 has a generally rectangular top wall 10, top wall 10 having a first end 11 and a second end 12. Extending between first end 11 and second end 12 of top wall 10 are side edges 13. As best shown in FIG. 2, fluid container 5 has an opposed and generally coplanar bottom wall 14, bottom wall 14 also having a first end 15 and a second end 16. Extending between top wall 10 and bottom wall 14 is a pair of opposed and coplanar sidewalls 18, front wall 22, and an opposed and coplanar back wall 26. Each of walls 10, 14, 18, 22, and 26 are generally rectangular in configuration, and are formed as generally planar surfaces.

As best shown in FIG. 1, each of opposed sidewalls 18 has a first end 19 and a second end 20. First end 19 of each sidewall 18 is connected to one of side edges 13 of top wall 10, and extends between first end 11 and second end 12 of top wall 10. Thereafter, second end 20 of each sidewall 18 is fastened to the side edges (not illustrated) of bottom wall 14, extending between its first end 15 and second end 16.

Still referring to FIG. 1, front wall 22 has a first end 23 and a second end 24. Front wall 22 also has a pair of opposed side edges 25 (FIG. 3) which extend between first end 23 and second end 24 of the front wall. First end 23 of front wall 22 is connected to first end 11 of top wall 10. Similarly, second end 24 of front wall 22 is fastened to first end 15 of bottom wall 14. Side edges 25 of front wall 22 are connected along their length to the side edges of each adjacent sidewall 18, best shown in FIG. 1.

Referring now to FIG. 2, back wall 26 has a first end 27 and a second end 28. First end 27 of back wall 26 is fastened to second end 12 of top wall 10. The side edges (not illustrated) of back wall 26 are fastened along their length to the side edges (not illustrated) of each adjacent sidewall 18, and extend downward toward bottom wall 14. In fashion similar to the front wall, second end 28 of back wall 26 is fastened to second end 16 of bottom wall 14.

As best shown in FIG. 2, fluid container 5 has an angled interior partition 30, the purpose of which is to assist in complete and full drainage of the fluid held within fluid container 5 as the fluid is passed out of fluid outlet opening 32, described in greater detail below. Still referring to FIG. 2, interior partition 30 is formed as a generally rectangular and planar member. Interior partition 30 is fastened along each of its side edges (not illustrated) to sidewalls 18, front wall 22, and back wall 26, respectively. Interior partition 30 is fastened to each of these walls so that it is sealed on them, the fluid to be held in fluid container 5 being positioned between top wall 10, sidewalls 18, front wall 22, back wall 26, and interior partition 30. Thus, as constructed, and as best shown in FIG. 2, interior partition 30 is spaced above bottom wall 14, and is positioned within fluid container 5 intermediate the first ends and second ends of sidewalls 18, front wall 22, and back wall 26, respectively. Moreover, interior partition 30 is angled downward from back wall 26 toward front wall 22.

Still referring to FIG. 2, interior partition 30 is fastened along its forward edge (not illustrated) to front wall 22 adjacent second end 24 of the front wall, in order to maximize the useable amount of volume for storage of fluid inside of fluid container 5. However, and if so desired, interior partition 30 can be located at any point intermediate the first ends and second ends of each of the sidewalls, front wall, and back wall, respectively. Moreover, and although it is not illustrated herein, an opening can be provided along the second end 28 of back wall 26 to provide access to the space which exists between bottom wall 14 and interior partition 30, so that rags, towels, or other items can be stored in an integral storage chamber formed as a part of fluid container 5. In the alternative, it is anticipated that the space between interior partition 30 and bottom wall 14 could be filled with styrofoam or any other resilient material to act as either a cushion, and/or to weight bottom wall 14 of fluid container 5 for stability when the fluid container is placed on engines, body work, or any other surface on which fluid container 5 may be rested.

Figure 3:
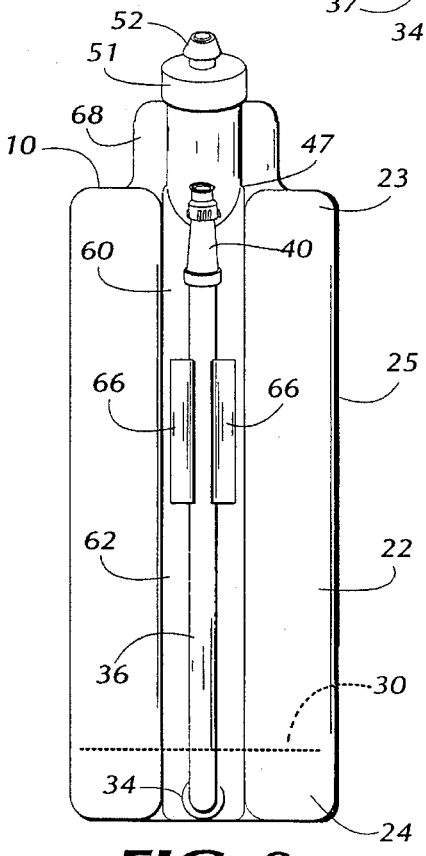
FIG. 3 is a front elevational view of the fluid dispensing container of FIG. 1.

Although fluid container 5 is shown in FIGS. 1–3 as having rounded corners, it is understood by those knowledgeable in the art that the corners of fluid container 5 can be formed as right angles, rounded, or constructed in any similar configuration so long as they form a sealed container as best shown in FIGS. 1 and 2, fluid container 5 is also provided with a pair of recessed cross ribs 29 formed in each of sidewalls 18 to add structural rigidity to sidewalls 18, and thus the fluid container.

Referring now to FIG. 2, a fluid outlet opening 32 is defined in the second end 24 of front wall 22, immediately above, and adjacent, interior partition 30 so that fluid container 5 can be emptied without having to tilt or angle fluid container 5 with respect to and toward fluid outlet opening 32. Still referring to FIG. 2, a fluid outlet conduit 34 is fastened in sealed fluid communication with fluid outlet opening 32. A flexible hose 36, having a first end 37 and a second end 38, is fastened at its first end 37 in sealed fluid communication with the other end of fluid outlet conduit 34. A nozzle 40 is fastened in sealed fluid communication with the second end 38 of hose 36.

Figure 5:
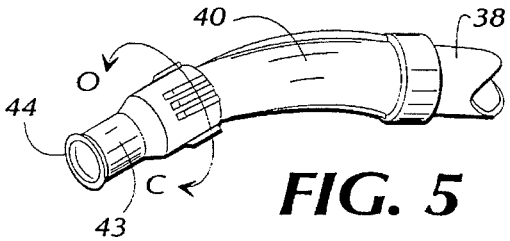
FIG. 5 is a perspective view of the nozzle fastened in sealed fluid communication with the hose of the fluid dispensing container of FIG. 1

Turning now to FIG. 5, nozzle 40 is shown in sealed fluid communication with second end 38 of hose 36. Nozzle 40 is adapted to be selectively opened and closed for the passage of fluid from fluid container 5 through the nozzle. This is shown by the notations "o" and "c" in FIG. 5. As also shown in FIG. 5, nozzle 40 has a pour spout member 43 provided at its end opposite the end of the nozzle fastened to hose 36. An annular lip or protruding ridge 44 is formed along that portion of the periphery of pour spout 43 transverse to the length of the nozzle, so that lip 44 is formed to be generally perpendicular or transverse to the length of the nozzle. The purpose behind annular lip 44 is to provide a catch or hook for holding nozzle 40 within the openings of any fuel tanks, fluid containers, or vessels into which fluid is being transferred from fluid container 5, through hose 36, and nozzle 40. So constructed, nozzle 40 can be placed into the opening of a fuel tank, for example, the nozzle moved into its open position, and left in position while also supporting itself in the fuel tank fill opening as fuel is drained out off fluid container 5 into the fuel tank. Nozzle 40 can be any conventional nozzle so long as it is constructed to be sealingly and permanently fastened to second end 38 of hose 36. Also, pour spout 43 of nozzle 40, or its equivalent, is adapted to be sealed on nozzle 40 when it is not desired to pass fluid through nozzle 40 and out of fluid container 5. One example, of a nozzle which is adapted for use with fluid container 5 is that disclosed in U.S. Pat. No. 5,000,360 to Lown et al., entitled Pouring Spout Which Can Be Selectively Opened and Closed.

Referring now to FIGS. 1 and 2, and as best shown in FIG. 2, a fluid inlet opening 46 is defined at corner 47 of fluid container 5. Corner 47 is formed where top wall 10 is joined at its first end 11 to first end 23 of front wall 22. A fluid fill conduit forming part of fluid inlet opening 46 is fastened in sealed fluid communication with the fluid inlet opening and extends upwardly at an angle from the fluid container with respect to both top wall 10 and front wall 22. A cap assembly 50 is removably provided at the other end of fluid fill conduit 48 opposite fluid inlet opening 46, to seal the opening closed. Cap assembly 50 is illustrated in greater detail in FIG. 4.

Figure 4:
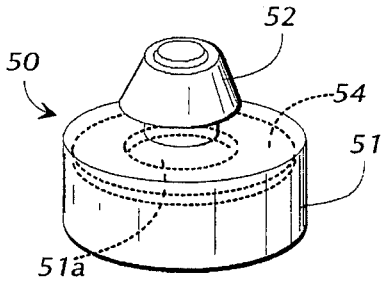
FIG. 4 is a perspective view of the cap, and integral vent, placed on the fluid fill conduit of the fluid dispensing container of FIG. 1.

Referring now to FIG. 4, cap assembly 50 has a cap portion 51, cap portion 51 having an opening 51*a* defined therein at which a vent 52 is provided. Vent 52 is adapted to be selectively opened and closed, and is shown in its closed position in FIG. 4 so that fluid, to include liquid and gases, for example air, cannot be passed through cap assembly 50 into or out of fluid container 5. In its closed position, FIG. 4, vent 52 will be sealed on cap portion 51 so that fluid cannot pass into or out of the fluid container. Vent 52 is provided to relieve pressure build up and to vent the interior of fluid container 5 when fluid is being drawn out of the fluid container through fluid outlet opening 32, hose 36, and/or nozzle 40. Referring now to FIG. 2, vent 52 is shown in its open position, so that air can be vented into the interior of fluid container 5 while fluid is drawn from fluid container 5 through hose 36 and nozzle 40.

Thus, and as constructed, it is a feature of fluid container 5 that when nozzle 40 is opened for the passage of fluid out of the container, interior partition 30 will assist in complete drainage of the fluid held in the container through fluid outlet opening 32, the passage of fluid being assisted also through the opening of vent 52 in cap assembly 50 so that a vacuum is not formed inside the fluid container as fluid is passed out of the container.

Referring again to FIG. 4, a washer or rubber gasket 54 is provided as a part of cap portion 51 for sealing cap portion 51 on the open end of fluid fill conduit 48. Although it is not illustrated herein, it is anticipated that cap portion 51 will be threaded as will be the free end of fluid fill conduit 48, cap assembly 50 being threadedly received on fluid fill conduit 48. It is also possible that cap assembly 50 could be a snap assembly which will snap onto an annular catch ridge (not illustrated) on fluid fill conduit 48, rather than being threaded thereon.

Flexible hose 36 is constructed of a flexible and durable material which will be resistant to chemical attack or corrosion from the fluids transported and carried within fluid container 5. As best shown in FIG. 2, hose 36 is permanently affixed, in sealed fluid communication, with the end of fluid outlet conduit 34 opposite fluid outlet opening 32. Hose 36 can be constructed of any natural or synthetic rubber like material for flexibility, or can be constructed of any durable and flexible plastic tubing or other material. It is possible, although not illustrated herein, that hose 36 can be made of wire braided hose, fiberglass reinforced hose, or even a flexible metallic hose. Second end 38 of hose 36 is permanently affixed to, and in sealed fluid communication with, nozzle 40.

As best shown in FIGS. 1–3, a recessed channel 60 is formed in and along a portion of the length of front wall 22. The purpose of recessed channel 60 is to provide a channel in which hose 36 can be stored and protected when the hose is not in use. Referring now to FIG. 2, recessed channel 60 has a recessed front wall section 62, recessed front wall section 62 having a first end 63 and a second end 64. First end 63 of recessed front wall section 62 forms a portion of corner 47 defined where first end 11 of top wall 10 and first end 23 of front wall 22 form corner 47, the corner being where fluid fill conduit 48 is formed as a part of fluid container 5. Although recessed channel 60 is shown here as being generally rectangular in shape, see FIGS. 2 and 3, recessed channel 60 can be of any configuration so long as it is adapted to protect hose 36 when it is held by clamps 66 within the channel. Clamps 66 can be any conventional form of spring clamp, or retaining clip, adapted to removably receive hose 36, yet hold it securely; within recessed channel 60 when hose 36 is not being used. As illustrated in FIG. 1, hose 36 is shown being held by clamps 66 within the channel, so that hose 36 will be protected when not in use. Also, clamps 66 serve the purpose of holding hose 36 on fluid container 5 so that it is easier to carry and transport the fluid container without hose 36 dangling or dragging from the fluid container.

As best shown in FIG. 3, fluid outlet opening 32 and fluid inlet opening 46, as well as fluid outlet conduit 34 and fluid inlet conduit 48, lie along a common axial line. However, fluid outlet opening 34 and fluid inlet opening 46 need not lie along a common axial line, the only requirement being that fluid outlet opening 34 be defined in the second end of front wall 22, and/or the second end 64 of recessed front wall section 62, and fluid inlet opening 46 being defined at the first end 23 of front wall 22 and/or first end 63 of recessed front wall section 62. Also, and not illustrated herein, fluid fill conduit 48 can extend from the corner of top wall 10, front wall 22, and one of sidewalls 18, so that the fluid fill conduit extends upward at an angle with respect to top wall 10, sidewall 18, and front wall 22.

Referring now to FIGS. 1 and 2, a handle 68 is formed and provided as an integral portion of top wall 10. Handle 68 can be solid or, as shown, hollow, so that fluid can be stored within handle 68 as part of fluid container 5.

Fluid container 5 is constructed of a durable and rigid plastic resistant to attack from chemical or corrosive fluids, to include motor fuels, lubricants, hydraulic fluid, chemical solvents, or other chemicals and fluids carrier therein. Also, by constructing fluid container 5 of a rigid and durable plastic, the fluid container can be injection molded for ease of assembly, and should also provide improved resistance to deformation or damage as the fluid container is used. Although it is anticipated that fluid container 5, as discussed above, will be constructed of rigid and durable plastic, it is also possible that fluid container 5, with the possible exception of hose 36, nozzle 40, and cap assembly 50, can be constructed of galvanized steel or any other metallic substance adapted for use as a fluid and/or fuel container, as well as stainless steel if it is desired to use fluid container 5 for the transport of potable fluids, such as coffee, tea, and/or milk, in food service usage. Hose 36 will be constructed as described hereinabove. It is anticipated that nozzle 40, cap portion 51 and vent 52 will be constructed of the same rigid and durable plastic of which fluid container 5 is constructed, although nozzle 40 can be constructed of any suitable metallic material as well. Gasket 54 will be constructed of any flexible and resilient material, such as natural or synthetic rubber, or any of the flexible plastics adapted for use as a washer and/or gasket to seal cap portion 51 on fluid fill conduit 48.

A feature of this fluid container is that it can be stored in two positions both of which will help ensure that the fluid container does not spill or leak fluid carried and stored therein. As shown in FIGS. 1–3, fluid container 5 is supported on its bottom wall 14. However, it is anticipated that fluid container can also be stored along its back wall 26, and that a plurality of fluid containers can be stacked one on top of the other by placing back wall 26 along front wall 22 of the fluid container beneath it, and so on. So constructed, fluid container 5 can be stacked along its back wall 26, one against the other, and on top of one another, to maximize and efficiently use the space in which fluid container 5 is used for the transport and storage of fluid.

It is possible to store fluid container 5 on its back wall 26 due to its unique construction, as shown best in FIG. 2. If FIG. 2 is rotated so that back wall 26 is moved into a generally horizontal position, it can be seen that any fluid held within fluid container 5 will lie below front wall 22 and will be carried in the container so that it is not readily able to pass through fluid outlet opening 32, or through fluid inlet opening 46, as well as fluid fill conduit 48, and out of the container. In the event that fluid within the container is sloshed while fluid container 5 is stored on its back wall 26, the construction of the fluid container by providing a nozzle 40 which can be selectively closed and sealed on hose 36, as well as a cap assembly 50 which can be sealed on fluid inlet opening 46 and fluid fill conduit 48, as well as providing a vent 52 which is selectively adapted to be opened and closed in a sealed position on cap portion 51, helps to ensure that fluid container 5 will be less likely to spill fluid as are other containers known in the art.

Also, it is a feature of fluid container 5, through its construction, that it can be placed on, for example, the rear trunk lid of an automobile while hose 36 is released from clamps 66, and nozzle 40 placed inside the fuel tank opening of an automobile, the nozzle being supported therein by lip 44, nozzle 40 being moved into its open position, vent 52 being opened, and fuel passing from fluid container 5 into the fuel tank of automobile without having to hold fluid container 5 in space with respect to the opening of the automobile fuel tank, nor without having to tilt or angle fluid container 5 so that fuel is passed through the equivalent of fluid fill conduit 48, as in conventional containers, rather than through attached hose 36 and nozzle 40. In like fashion, fluid container 5 can be used for transferring fluids into garden and lawn equipment, as well as construction equipment, by placing the fluid container on the surface of the machinery or equipment, removing hose 36 from clamps 66, placing the nozzle within any appropriate fluid fill opening, and opening the nozzle and passing fluid from fluid container 5 into the fluid reservoir or tank of the equipment. Fluid container 5 can be used for carrying, transporting, and transferring fuels, coolants, such as water or antifreeze, hydraulic fluid, or motor lubricating oils.

While a preferred embodiment of the invention has been disclosed in the foregoing specification, it is understood by those skilled in the art that variations and modifications thereof can be made without departing from the spirit and scope of the invention, as set forth in the following claims:

I claim:

1. A fluid dispensing container, comprising:

a top wall having a first end and a second end;

a bottom wall having a first and second end;

a front wall, a back wall, and a pair of spaced sidewalls, each of said walls having a first end and a second end;

wherein said sidewalls are each fastened at their first end to the side edges of said top wall and extend between the first end and second end of said top wall, said front and back walls being fastened at their first ends to the first and second ends, respectively, of said top wall and being fastened along their common side edges to each of said sidewalls;

an interior partition positioned within the container spaced intermediate the first end and second end of said front wall, said back wall, and said sidewalls, the partition being sealed along its edges to said front wall, said back wall, and said sidewalls, said partition being angled downwardly from the back wall toward the front wall with respect to the front wall, back wall, and sidewalls;

a space between the partition and bottom wall for storing items;

a fluid outlet opening defined in the front wall, said opening being positioned in the front wall intermediate said top wall and said partition and also being adjacent said partition;

an elongated hose having a first end and second end, the first end of said hose being in sealed fluid communication with said fluid outlet opening;

a nozzle in sealed fluid communication with the second end of said hose, the nozzle being adapted to be selectively opened and closed;

a fluid inlet opening defined in the container where said front wall and said top wall are joined together, said fluid inlet opening being angled away with respect to both the top wall and the front wall of the container; and cap means disposed on said fluid inlet opening for sealing the fluid inlet opening on the container;

whereby fluid is dispensed from the container through the hose when the nozzle is opened while the interior partition assists in the passage of fluid from the container, and whereby the container can be stored and transported not only in an upright position but may also be placed on its back wall so that both the fluid inlet and outlet openings face upward to prevent leakage of fluid stored and carried in the container.

2. The container of claim 1, wherein said top wall, said front wall, said back wall, and said sidewalls are each generally rectangular.

3. The container of claim 1, wherein said interior partition is sealed to said front wall along the second end of said front wall.

4. The container of claim 3, wherein said partition is generally rectangular.

5. The container of claim 1, wherein said top wall includes a handle formed as an integral portion of said top wall.

6. The container of claim 1, wherein said elongated hose comprises a flexible hose.

7. The container of claim 1, wherein said nozzle includes a pour spout, and an annular lip formed along the periphery of said pour spout transverse to the length of said nozzle.

8. The container of claim 1, wherein the container further comprises clamp means disposed on the container for holding said hose when the hose is not being used.

9. The container of claim 8, wherein said clamp means is mounted on the front wall of the container.

10. The container of claim 8, wherein said front wall of the container further comprises a channel formed as an integral part of said front wall for receiving said hose.

11. The container of claim 10, wherein said channel is recessed into the front wall of the container and extends from the first end of the front wall to the second end of the front wall of the container.

12. The container of claim 11, wherein said clamp means is disposed within said channel.

13. The container of claim 1, wherein said fluid inlet opening comprises a fluid fill conduit connected at one of its ends in scaled fluid communication with the container, the other end of said fluid fill conduit being adapted to receive said cap means.

14. The container of claim 1, wherein said cap means comprises a cap with an integral vent formed as a part of said cap, said vent being adapted to be selectively opened and closed for relieving pressure in and venting the interior of the container.

15. The container of claim 1, wherein said fluid outlet opening comprises a conduit fastened at one of its ends in sealed fluid communication with the container, the other end of said conduit being adapted to receive said hose.

16. The container of claim 1, wherein the container is constructed of plastic.

17. A container for dispensing fuel and other fluids, comprising:

a generally rectangular top wall having a first end and a second end;

a bottom wall having a first and second end;

a handle formed as an integral part of said top wall;

a generally rectangular front wall, a generally rectangular back wall, and a pair of generally rectangular sidewalls, each of said walls having a first end and a second end;

wherein said sidewalls are each fastened at their first end to the side edges of said top wall and extend between the first end and second end of said top wall, said front wall and said back wall being fastened at their first end to the first end and second end, respectively, of said top wall and also being fastened along their common side edges to each of said sidewalls;

a generally rectangular interior partition positioned within the container and spaced intermediate the first end and second end of said front wall, said back wall, and said sidewalls, said partition being sealed along its edges to said front wall, said back wall, and said sidewalls;

wherein said partition extends downwardly from said back wall toward said front wall with respect to said front wall, said back wall, and said sidewalls, said partition being sealed to said front wall along the second end of said front wall;

a space between the partition and bottom wall for storing items;

a fluid outlet opening defined in the front wall spaced above and adjacent said partition;

an elongated flexible hose having a first end and second end, the first end of said hose being in sealed fluid communication with said fluid outlet opening;

clamp means disposed on the container for holding said hose;

a nozzle in sealed fluid communication with the second end of said hose, the nozzle being adapted to be selectively opened and closed for passing fluid through the hose;

a fluid inlet opening defined in the container where said front and top walls are joined together, said fluid inlet opening being angled away from both the top wall and front wall of the container; and a cap removably received on said fluid inlet opening for sealing the fluid inlet opening on the container, said cap including an integral vent adapted to be selectively opened and closed;

whereby fluid is drained from the container through the hose when the nozzle and vent are opened while the interior partition assists in the passage of fluid from the container, and whereby the container can be stored and transported not only in an upright position but may also be placed on its back wall so that both the fluid inlet and outlet openings face upward to prevent leakage of fluid stored and carried in the container.

18. The container of claim 17, wherein said front wall further comprises a channel formed as an integral part of said front wall for receiving said hose.

19. The container of claim 18, wherein said channel is recessed into the front wall of the container and extends along the length of the front wall of the container.

20. The container of claim 19, wherein said clamp means is disposed within said channel.

21. A fluid dispensing container, comprising: a top wall having a first end and a second end;

a bottom wall having a first end and a second end;

a front wall having a first end and a second end;

a back wall having a first end and a second end;

a pair of spaced sidewalls each having a first end and a second end;

each of said sidewalls being fastened at its first end to the side edges of said top wall and at its second end to the side edges of said bottom wall, each of said sidewalls extending between the first end and second end of said top wall and bottom wall, respectively;

said front wall being fastened at its first end to the first end of said top wall and at its second end to the first end of said bottom wall:

said back wall being fastened at its first end to the second end of said top wall and at its second end to the second end of said bottom wall;

the top wall, the bottom wall, the front wall, the back wall, and the sidewalls being sealingly fastened to one another along their common edges;

an interior partition positioned within the container spaced intermediate the top wall and bottom wall of the container, said partition being sealed along its edges to said front wall, said back wall, and each of said sidewalls, said partition extending downwardly from the back wall of the container toward the front wall of the container;

a space between the partition and bottom wall for storing items;

a fluid outlet opening defined in said front wall, the fluid outlet opening being spaced intermediate said top wall and said partition and being adjacent said partition;

an elongated hose having a first end and second end, the first end of said hose being in sealed fluid communication with said fluid outlet opening;

a nozzle in sealed fluid communication with the second end of said hose, the nozzle being adapted to be selectively opened and closed for passing fluid through the hose;

a fluid inlet opening defined in the container, said fluid inlet opening being angled away from both the top wall and front wall of the container; and cap means disposed on said fluid inlet opening for sealing the fluid inlet opening on the container.

22. A container for fuel and other fluids, comprising:

a top wall and a generally parallel and spaced bottom wall;

a handle formed as an integral part of said top wall;

at least one generally upstanding sidewall fastened along its top and bottom edges to said top wall and said bottom wall, respectively;

an interior partition positioned within the container and spaced intermediate said top wall and said bottom wall, said partition being sealed along its edges to said at least one sidewall;

a space between the partition and bottom wall for storing items;

said partition being angled away from said top wall and toward said bottom wall;

a fluid outlet opening defined in said at least one sidewall, the fluid outlet opening being spaced intermediate said top wall and said partition and being adjacent said partition;

an elongated flexible hose having a first end and second end, the first end of said hose being in sealed fluid communication with said fluid outlet opening;

clamp means disposed on the container for holding said hose;

a nozzle in sealed fluid communication with the second end of said hose, the nozzle being adapted to be selectively opened and closed for passing fluid through the hose;

a fluid inlet opening defined in said container, said fluid inlet opening being angled away from said top wall and said at least one sidewall; and a cap removably received on said fluid inlet opening for sealing the fluid inlet opening on the container, said cap including an integral vent adapted to be selectively opened and closed.

* * * * *